US005193991A

United States Patent [19]

Koebler et al.

[11] Patent Number: 5,193,991

[45] Date of Patent: Mar. 16, 1993

[54] LIQUEFIED CARBON DIOXIDE PUMP

[75] Inventors: Douglas J. Koebler, Irwin; Glen P. Williams, Pittsburgh, both of Pa.

[73] Assignee: Suprex Corporation, Pittsburgh, Pa.

[21] Appl. No.: 663,316

[22] Filed: Mar. 1, 1991

[51] Int. Cl.[5] ..... F04B 39/10

[52] U.S. Cl. ..... 417/571; 62/50.6

[58] Field of Search ..... 417/567, 53, DIG. 1; 62/50.6, 50.1

[56] References Cited

U.S. PATENT DOCUMENTS

| | | | |
|---|---|---|---|
| 1,740,108 | 12/1929 | Marshall | 417/567 |
| 1,939,611 | 12/1933 | Purvis | 62/50.6 |
| 2,439,957 | 4/1948 | Anderson | 103/1 |
| 2,439,958 | 4/1948 | Anderson | 103/1 |
| 2,440,216 | 4/1948 | Anderson | 103/1 |
| 2,640,432 | 6/1953 | Chappelle | 103/153 |
| 2,705,873 | 4/1955 | Bonnaud | 62/50.6 |
| 2,841,092 | 7/1958 | Whiteman et al. | 103/153 |
| 2,972,960 | 2/1961 | Philip | 103/153 |
| 3,016,717 | 1/1962 | Gottzmann | 62/55 |
| 3,106,169 | 10/1963 | Prosser et al. | 417/567 |
| 3,220,351 | 11/1965 | Kling | 103/153 |
| 3,344,746 | 10/1967 | Scovell | 103/153 |
| 4,395,442 | 7/1983 | Meise et al. | 427/236 |
| 4,396,354 | 8/1983 | Thompson et al. | 417/53 |
| 4,456,440 | 6/1984 | Korner | 417/540 |
| 4,516,479 | 5/1985 | Vadasz | 417/DIG. 1 |
| 4,573,886 | 3/1986 | Maasberg et al. | 417/454 |
| 4,751,822 | 6/1988 | Viard | 62/50.6 |
| 4,792,289 | 12/1988 | Nieratschker | 417/259 |
| 5,033,940 | 7/1991 | Baumann | 417/DIG. 1 |

FOREIGN PATENT DOCUMENTS

| | | |
|---|---|---|
| 0054625 | 6/1982 | European Pat. Off. . |
| 0303553 | 7/1989 | European Pat. Off. . |
| 3621727 | 1/1988 | Fed. Rep. of Germany . |
| 359997 | 3/1962 | Switzerland . |
| 1557433 | 12/1979 | United Kingdom . |

*Primary Examiner*—Richard A. Bertsch
*Assistant Examiner*—Charles G. Freay
*Attorney, Agent, or Firm*—Buchanan Ingersoll, Michael L. Dever

[57] ABSTRACT

A pump for liquefied gases is provided having a low thermal conductivity liner provided in the inner bore of the pump cylinder. The low thermal conductivity liner prevents transmission to the pump cylinder of heat generated during the compression of the liquefied gas. The liner is preferably formed from a ceramic, such as zirconium, or from a plastic. In addition to the provision of the low thermal conductivity liner, techniques for reducing the dead volume of retained gases in the pump chamber are utilized to prevent the transmission of retained heat from the these gases to the incoming charge of liquefied gases.

27 Claims, 1 Drawing Sheet

LIQUEFIED CARBON DIOXIDE PUMP

BACKGROUND OF THE INVENTION

1. Field of the Invention

The present invention relates to the field of pumps for liquefied gases and more particularly to pumps for pumping pressurized carbon dioxide which is liquid at room temperature.

2. Description of the Prior Art

Pumps are known in the prior art for pumping liquefied carbon dioxide to increase the pressure of the carbon dioxide in order to create super-critical fluids using the carbon dioxide. The carbon dioxide to feed the pump is stored at a pressure at which it remains liquefied at room temperature. However, when the carbon dioxide is pumped, it may vaporize due to heat that it absorbs from the pump head.

In these prior art pumps, heat is generated during the pumping process by the compression of the carbon dioxide. This heat is transferred to the piston and pump cylinder causing the piston and pump cylinder to heat up. As the piston and pump cylinder heat up, at least a portion of the entering charge of carbon dioxide to be pumped is vaporized. Because the volume of a given mass of a gas is larger than the volume of the same mass of a liquid, the conversion of even a portion of the incoming charge of liquefied carbon dioxide to gaseous carbon dioxide causes a reduction in the available volume of liquefied carbon dioxide which can be pumped by the carbon dioxide pump.

U.S. Pat. Nos. 2,439,957; 2,439,958; and 2,440,216 show one approach which has been used to counteract the transfer of the heat generated from the compressed carbon dioxide to the piston and pump cylinder. These prior art pumps provide a sleeve enclosing the pump cylinder. In a second embodiment, a portion of the liquefied carbon dioxide that feeds the pump is blown through the chamber created between the sleeve and pump cylinder. The liquefied carbon dioxide cools the pump cylinder, thereby removing the heat generated during compression of the liquefied carbon dioxide. Because the carbon dioxide blown through the chamber is taken from the supply of liquefied carbon dioxide to be pumped, a portion of the supply of liquefied carbon dioxide is wasted. Other prior art pumps circulate alternative cooling fluids such as water, glycol and the like through the chamber between the sleeve and the pump cylinder to flush the chamber and thus cool the pump. The use of such cooling fluids increase the cost to use these pumps. Consequently, there is a need for an improved pump design which prevents the transfer of heat from the compressed liquefied carbon dioxide to the pump cylinder without exhausting any of the supply of the liquefied carbon dioxide or resorting to the additional need of other cooling fluids.

SUMMARY OF THE INVENTION

A piston pump for compressing liquefied gases is provided in which a pump cylinder has an inner portion formed from material of low thermal conductivity. The inner portion has a cylindrical bore which slidingly receives the piston of the pump as the pump compresses the liquefied gas. The inner portion is preferably formed of a ceramic or polymer or other material having low thermal conductivity provided on the inside of the pump cylinder. The inner portion prevents the transfer of heat from the compressed liquefied carbon dioxide to the pump cylinder. The piston contacts this liner as it moves within the pump cylinder.

When a new stroke of the pump is initiated, the piston is drawn back and liquefied carbon dioxide is taken in to the pump cylinder. As the liquefied carbon dioxide is compressed during the pumping stroke, heat is generated. This generated heat remains in the compressed liquefied carbon dioxide because the low thermal conductivity of the ceramic liner retards heat transfer to the pump cylinder. When the pumping stroke is completed, the generated heat is forced out of the pump with the compressed carbon dioxide. When the new pumping stroke is initiated, the new charge of carbon dioxide is not subjected to retained heat and remains liquefied as it is being drawn into the pump and then subsequently compressed.

To further prevent the retention of generated heat in the pump cylinder, the dead volume of the pump cylinder is kept to a minimum. This is accomplished by allowing the piston face to approach the cylinder head as close as possible. In addition, the check valves for the incoming liquefied carbon dioxide and exiting carbon dioxide are specially designed to minimize the amount of dead volume.

DETAILED DESCRIPTION OF THE PREFERRED EMBODIMENTS

Figure 1:
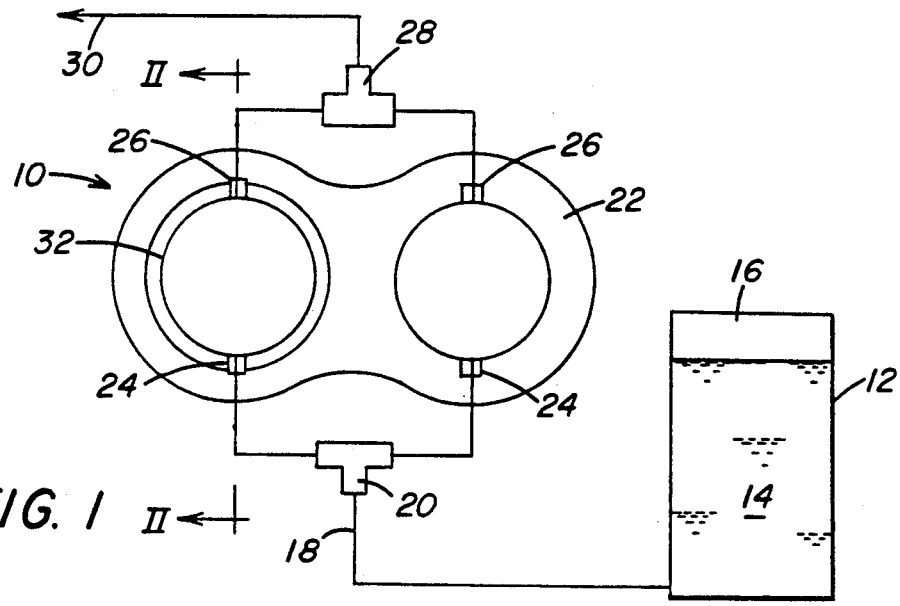
FIG. 1 is a schematic representation of the pump of the present invention.

As shown in FIG. 1, pump 10 is designed to compress liquefied carbon dioxide with a helium pressurized head space 16 stored in storage tank 12. Tank 12 stores the liquefied carbon dioxide 14 at room temperature and is maintained at a pressure of approximately 1100–1300 psi. Helium gas used to pressurize the head space 16 provided in helium head storage tank 12 maintains the pressure of tank 12 as the liquefied carbon dioxide is emptied.

The carbon dioxide in liquefied form is drawn from supply tank 12 through input line 18 and split into two streams by T-connector 20. Each stream from T-connector 20 is directed to a different cylinder head 22. Special dead volume minimizing check valves 24 are provided in the input streams to cylinder heads 22. Dead volume minimizing check valves 26 direct the compressed liquefied carbon dioxide out of cylinder head 22. T-connector 28 combines the two output streams to form output line 30.

Figure 2:
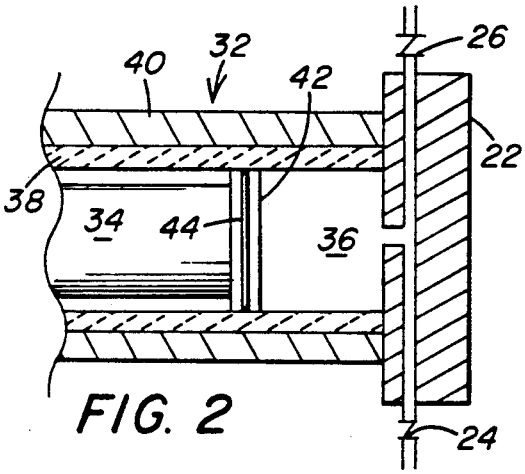
FIG. 2 is a cross-sectional representation of a first presently preferred embodiment of the pump head of FIG. 1 taken along the line II—II of FIG. 1.

FIG. 2 shows the pump head 32 for each of cylinder heads 22. As piston 34 in pump head 32 retreats, liquefied carbon dioxide is drawn into chamber 36 where it remains in liquid form. As piston 34 advances, the liquefied carbon dioxide is further pressurized. Preferably, the operation of each pump head 32 is synchronized so that while piston 34 in one pump head 32 is pressurizing, piston 34 in the other pump head 32 is retreating.

In the present preferred embodiment of FIG. 2, the heat generated during the compression of the liquefied carbon dioxide by piston 34 is retained in the carbon dioxide. Low thermal conductivity liner 38 provided within pump cylinder 40 prevents transmission of the generated heat into the body of the pump cylinder 40.

When piston 34 is forced forward, the incoming liquefied carbon dioxide having a pressure of approximately 1100–1300 psi is pressurized to approximately 7500 psi (500 atmosphere). If desired, the carbon dioxide can be pressurized up to approximately 10,000 psi. Because pump cylinder 40 is lined with low thermal conductivity liner 38, the heat generated during the compression of the carbon dioxide exits with the carbon dioxide through check valve 26 provided in cylinder head 22. The low thermal conductivity liner 38 protects pump cylinder 40 from conduction of the generated heat.

Preferably, liner 38 is formed of a wear resistant, nonreactive, non-absorbent material such as ceramic or polymer. It has been found that the ceramic material zirconia ($ZrO_2$) performs well as a liner 38. In addition to ceramics, other materials, such as plastics, can be used as liners 38 if they provide the wear resistant, non-reactive and non-absorbent properties necessary for an effective liner 38. One such other material is polyethylethylketone (PEEK), a plastic which provides the desired low conductivity properties. However, because PEEK absorbs carbon dioxide, a liner 38 formed from PEEK eventually swells to the point that piston 34 binds with liner 38. Proper dimensional design of a PEEK liner 38 to accommodate the carbon dioxide absorption can help reduce binding of piston 34 therein.

Preferably, as shown in FIGS. 1 and 2, a single input line 18 runs between two low dead volume check valves 24. That single line 18 has a T-connection 20 at the cylinder head 22. The dead space between the piston head 42 and the cylinder head 22 upon advancement of the stroke of the piston 34 is made as small as possible to minimize the volume of heated gas retained in chamber 36 and hence minimize the heat retained therein. Piston seal 44 is positioned as far forward on piston 34 as possible to minimize this dead space. Piston seal 44 may be positioned at the rear of piston 34 although such an embodiment has been experimentally found to be approximately 85% as efficient as the embodiment shown in FIG. 2. The small feed lines 18, 30 and the small check valves 24, 26 also minimize heat retained within the pump 10 by reducing the volume available for retaining heated gas. By a combination of the dead space reduction techniques of the present invention with the low thermal conductivity liner 38, the heat generated during compression of the carbon dioxide in pump 10 is exhausted with the exiting carbon dioxide.

Figure 3:
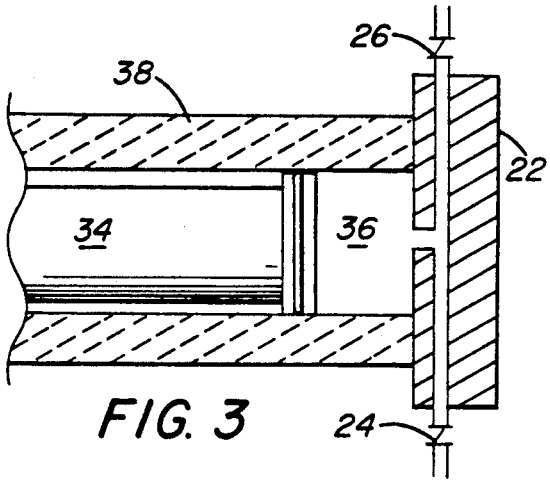
FIG. 3 is a cross-sectional representation of a second presently preferred embodiment of the pump head of FIG. 1.

FIG. 3 shows an alternative embodiment of the pump design in which the entire pump cylinder 38 is formed from the low thermal conductive material. It is essential for such an embodiment that the material have the strength to withstand high pressures such as those involved in this pumping process.

Figure 4:
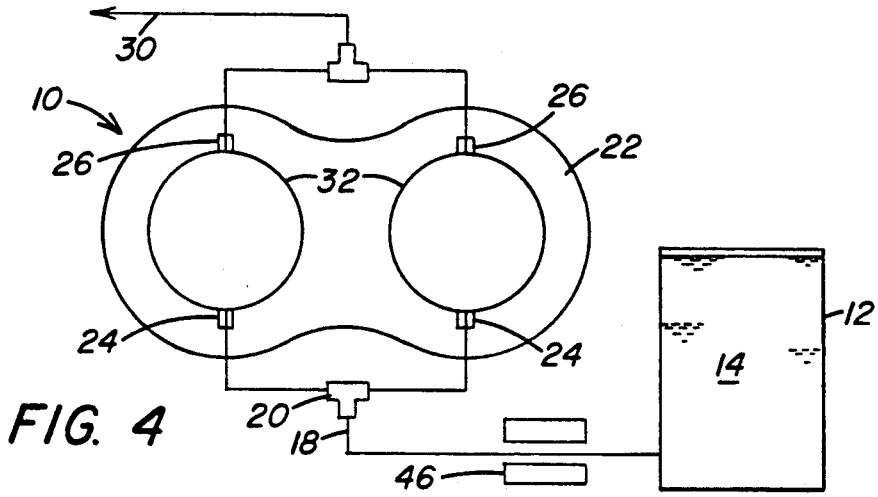
FIG. 4 is a schematic representation of an alternative pump arrangement in accordance with the present invention.

In some markets, primarily in Europe, helium head space pressurized carbon dioxide is not available. In those markets, the liquefied carbon dioxide is stored at 950–1050 psi (65–70 atm) much closer to the room temperature liquid/gas phase equilibrium than the 1100–1300 psi pressurized liquefied carbon dioxide stored in helium-head space storage tanks 12. Because a smaller amount of heat is necessary to convert such liquefied carbon dioxide to gas in the pump it may be necessary to pre-cool the carbon dioxide going into the pump 10. The precooling arrangement is performed with a commercially available thermal electric unit designated as 46 in FIG. 4. Thermal electric unit 46 maintains the carbon dioxide 14 in a liquefied state and cools it so that it can absorb a small amount of heat from the pump head and still remain a liquefied as the pumping process proceeds. Tests have been conducted on the pre-cooling of the carbon dioxide which is at a pressure of approximately 80 atmospheres. These tests indicate that commercially available thermal electric unit 46 can satisfactorily pre-cool the carbon dioxide entering pump 10.

Present experimental results indicate that zirconia ceramic provides the best liner 38 for pump 10. In a preferred method of construction, the zirconia is cast from zirconia powder, pressed, fired initially, and fired a second time. After the second firing, the zirconia is ground with a diamond bit and the interior of the zirconia annulus is ground smooth in order to receive the piston 34. Experimental results indicate that pump 10 provided with a zirconia liner 38 has been able to run 700 hours continuously and is now being utilized as a test instrument on an intermittent basis.

The desired properties of low thermal conductivity liner 38 include: (1) the lowest thermal conductivity possible to prevent heat transmission to the pump cylinder 40; (2) sufficient strength to withstand pressures as high as 500 atmospheres and greater; (3) sufficient wear resistance to withstand the continuous piston strokes rubbing against it; (4) a ceramic structure that is sufficiently dense that the piston 34 does not wear out the liner 38; (5) resistance to chemical reactivity with the carbon dioxide or other liquefied gas being compressed; and (6) the ability to withstand size expansion under pressure and the ability to not absorb the carbon dioxide under high pressure.

In preferred practice, pump 10 has two pump heads 32 and two reciprocating pistons 34. As one piston 34 advances, the other piston 34 retreats. This provides a desirable constant flow of pressurized liquefied carbon dioxide. The pair of check valves 24, 26 provided for each piston head 32 also assist in providing a constant flow of pressurized liquefied carbon dioxide. The pump 10 shown in FIG. 1 is a dual-head pump. Alternatively, the pump could be a single head pump. Dual-head pump 10 is preferred over a single head pump when increased flow rates are required.

The pressurized carbon dioxide may be conducted away from pump 10 through a series of conduit connections 30 to a damping chamber, not shown, to remove the pulsations from the batch pressurization of carbon dioxide charges to an oven of a super critical fluid chromatograph, not shown. The additional heat of the oven causes the highly pressurized carbon dioxide to turn super-critical. Other uses of the pressurized carbon dioxide may exist.

During the discussion of the preferred embodiments of this invention, the present invention has been described as it relates to compressing liquefied carbon dioxide to higher pressures. It is to be understood that the principles of the present invention apply to the further pressurization of liquefied gases other than liquefied carbon dioxide. The principles of the present invention also apply to further pressurization of liquefied carbon dioxide containing modifiers such as methanol, ethanol, polyproplylene carbonate, formic acid or other common liquid organic solvents. The modifiers may be present in the liquefied carbon dioxide in amounts up to 30%. Typically, the modifier is present in amounts in the range of approximately 1% to 15%.

In the foregoing specification certain preferred practices and embodiments of this invention have been set out. However, it will be understood that the invention may be otherwise embodied within the scope of the following claims.

I claim:

1. A piston pump for compressing liquefied gases comprising a pump cylinder having an inner portion formed from material of low thermal conductivity to limit the transfer of heat generated during compression of said liquefied gases from the compressed liquefied gases to said pump cylinder wherein said compressed liquefied gases retain said heat generated during compression of said liquefied gases, said inner portion having a cylindrical bore to slidingly receive the piston of said pump as said pump compresses said liquefied gases.

2. The pump of claim 1 wherein said material is a ceramic.

3. The pump of claim 2 wherein said material is zirconia.

4. The pump of claim 1 wherein said material is polyethyl ethyl ketone.

5. The pump of claim 1 wherein said inner portion comprises a liner in said pump cylinder.

6. The pump of claim 1 wherein said pump further comprises means for reducing the dead volume of gas in the pump chamber.

7. The pump of claim 6 wherein said means for reducing dead volume comprises a first check valve for introducing the liquefied gas into the pump and a second check valve for directing said compressed liquefied gas out of said pump, said first check valve and said second check valve being provided in a cylinder head provided in said pump to minimize the dead volume between said first and second check valves and said chamber.

8. The pump of claim 7 wherein said first check valve and said second check valve are low dead volume check valves.

9. The pump of claim 6 wherein said reducing means comprises a piston seal provided on the front portion of said piston, said piston seal adapted to approach the cylinder head on each advance of said piston.

10. The pump of claim 6 wherein said means for reducing dead volume comprises a piston seal provided on the rear portion of said piston.

11. The pump of claim 6 wherein said means for reducing dead volume comprises small diameter cylindrical passages.

12. The pump of claim 1 wherein said liquefied gas is carbon dioxide.

13. The pump of claim 12 wherein said liquefied gas includes a modifier.

14. The pump of claim 13 wherein said modifier is selected from the group of organic solvents consisting of methanol, ethanol, polyproplylene carbonate and formic acid.

15. The pump of claim 1 wherein said pump has a first piston pump head and a second piston pump head wherein as the piston in said first pump head advances, the piston in said second pump head retreats.

16. A method for compressing liquefied gases in a piston pump having a pump cylinder and an inner portion of said pump cylinder formed from material of low thermal conductivity comprising the steps of:

(a) feeding said liquefied gas under pressure at room temperature to said pump cylinder;

(b) advancing said piston in said pump cylinder to compress said liquefied gas, wherein said compressed liquefied gas absorbs the heat generated during compression; and (c) exhausting said liquefied gas from said pump cylinder, said exhausted liquefied gas containing the heat generated during said compression.

17. The method of claim 16 further comprising the step of reducing the dead volume of gas in said pump cylinder.

18. The method of claim 17 wherein said dead volume is reduced by providing first and second low dead volume check valves in the cylinder head adjacent said pump chamber.

19. The method of claim 18 wherein said dead volume is reduced by providing small diameter cylindrical passages between said first low dead volume check valve and said pump chamber and said pump chamber and said second low dead volume check valve.

20. The method of claim 17 wherein said dead volume is reduced by providing a piston seal on the advancing portion of said piston.

21. A method for compressing liquefied gases in a piston pump having a pump cylinder and an inner portion of said pump cylinder formed from material of low thermal conductivity comprising the steps of:

a. storing said liquefied gas under pressure at room temperature;

b. pre-cooling said liquefied gas under pressure;

c. feeding said pre-cooled liquefied gas to said pump cylinder;

d. advancing said piston in said pump cylinder to compress said liquefied gas, wherein said compressed liquefied gas absorbs the heat generated during compression; and e. exhausting said liquefied gas from said pump cylinder, said exhausted liquefied gas containing the heat generated during compression.

22. The method of claim 21 comprising the further step of providing a thermal electric unit wherein said liquefied gas under pressure is pre-cooled by said thermal electric unit.

23. A piston pump for compressing liquefied gases comprising a pump cylinder having an inner portion formed from polyethyl ethyl ketone, said inner portion having a cylindrical bore to slidingly receive the piston of said pump as said pump compresses said liquefied gases.

24. The pump of claim 23 wherein said liquefied gas is carbon dioxide, said liquefied gas including a modifier.

25. The pump of claim 24 wherein said modifier is selected from the group of organic solvents consisting of methanol, ethanol, polypropylene carbonate and formic acid.

26. A piston pump for compressing liquefied carbon dioxide including a modifier comprising a pump cylinder having an inner portion formed from material of low thermal conductivity, said inner portion having a cylindrical bore to slidingly receive the piston of said pump as said pump compresses said liquefied carbon dioxide.

27. The pump of claim 26 wherein said modifier is selected from the group of organic solvents consisting of methanol, ethanol, polypropylene carbonate and formic acids.

* * * * *